United States Patent [19]

Forester

[11] Patent Number: 4,804,456

[45] **Date of Patent: * Feb. 14, 1989**

[54] METHOD FOR CONTROLLING FOULING DEPOSIT FORMATION IN PETROLEUM HYDROCARBONS OR PETROCHEMICALS

[75] Inventor: David R. Forester, Spring, Tex.

[73] Assignee: Betz Laboratories, Inc., Trevose, Pa.

[ * ] Notice: The portion of the term of this patent subsequent to Mar. 25, 2003 has been disclaimed.

[21] Appl. No.: 146,630

[22] Filed: Jan. 21, 1988

Related U.S. Application Data

[63] Continuation-in-part of Ser. No. 944,153, Dec. 18, 1986, abandoned.

[51] Int. Cl.[4] ..... C10G 9/16

[52] U.S. Cl. ..... 208/48 AA; 585/950

[58] Field of Search ..... 208/48 AA, 48 R; 252/389.2, 389.24, 389.21; 585/950

[56] References Cited

U.S. PATENT DOCUMENTS

| | | | |
|---|---|---|---|
| 2,316,080 | 4/1943 | Loane et al. | 252/46.4 |
| 2,316,082 | 4/1943 | Loane et al. | 252/46.4 |
| 2,785,128 | 3/1957 | Popkin | 252/32.7 |
| 3,105,810 | 10/1963 | Miller | 208/48 |
| 3,123,630 | 3/1964 | Oberender et al. | 260/461 |
| 3,135,729 | 6/1964 | Kluge et al. | 260/139 |
| 3,162,671 | 12/1964 | Petersen et al. | 260/461 |
| 3,201,438 | 8/1965 | Reed | 260/461 |
| 3,271,295 | 9/1966 | Gonzalez | 208/48 |
| 3,271,296 | 9/1966 | Gonzalez | 208/48 |
| 3,281,359 | 10/1966 | Oberender et al. | 252/46.6 |
| 3,301,923 | 1/1967 | Skovronek | 260/953 |
| 3,405,054 | 10/1968 | Arkis et al. | 208/48 |
| 3,437,583 | 4/1969 | Gonzalez | 208/48 |
| 3,442,791 | 5/1969 | Gonzalez | 208/48 |
| 3,489,682 | 1/1970 | LeSuer | 252/32.7 |
| 3,567,623 | 3/1971 | Hagney | 208/48 |
| 4,024,048 | 5/1977 | Shell | 208/48 AA |
| 4,024,049 | 5/1977 | Shell | 208/48 |
| 4,024,051 | 5/1977 | Shell | 208/187 |
| 4,105,540 | 8/1978 | Weinland | 208/48 AA |
| 4,107,030 | 8/1978 | Slovinsky | 208/48 AA |
| 4,578,178 | 3/1986 | Forester | 208/48 AA |

FOREIGN PATENT DOCUMENTS

| | | | |
|---|---|---|---|
| 1205768 | 6/1986 | Canada | 208/48 AA |
| 985180 | 3/1965 | United Kingdom | 208/48 AA |

*Primary Examiner*—Patrick P. Garvin
*Assistant Examiner*—Elizabeth D. Irzinski
*Attorney, Agent, or Firm*—Alexander D. Ricci; Roslyn T. Tobe

[57] ABSTRACT

Methods for controlling the formation of fouling deposits in petroleum hydrocarbons or petrochemicals during processing at elevated temperatures are disclosed. The methods comprise adding from about 0.5–10,000 ppm of an amine salt of polyalkenylthiophosphonic acid to the desired petrochemical or hydrocarbon.

12 Claims, No Drawings

METHOD FOR CONTROLLING FOULING DEPOSIT FORMATION IN PETROLEUM HYDROCARBONS OR PETROCHEMICALS

CROSS REFERENCE TO RELATED APPLICATIONS

The present application is a continuation-in-part of application Ser. No. 944,153, filed Dec. 18, 1986, now abandoned.

FIELD OF THE INVENTION

The present invention pertains to a method for providing antifouling protection for petroleum hydrocarbons or petrochemicals during processing thereof at elevated temperatures.

BACKGROUND

In the refinery and petrochemical processing of hydrocarbons (e.g., gasoline, gas, oils, naphthas, residuums, chlorinated hydrocarbons, etc.), the hydrocarbons are commonly heated to temperatures of 100° to 1500° F. (most commonly 500°-1000° F.). Similarly, such petroleum hydrocarbons are frequently employed as heating mediums on the "hot side" of heating and heat exchange systems. In such instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shutdowns for cleaning. Moreover, these deposits reduce throughput, which, of course, results in a loss of capacity with a drastic effect in the yield of finished product. Accordingly, these deposits have caused considerable concern to the industry.

While the nature of the foregoing deposits defies precise analysis, they appear to contain either/or a combination of carbonaceous phases which are coke-like in nature, polymers or condensates formed from the petroleum hydrocarbons or impurities present therein and salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process.

SUMMARY OF THE INVENTION

In accordance with the invention, I have found that addition of an amine salt of a polyalkenylthiophosphonic acid to the desired petroleum hydrocarbon or petrochemical significantly reduces the fouling tendencies of the petrochemical or petroleum hydrocarbon during the high temperature processing thereof.

PRIOR ART

Processes for preparing alkaline earth metal salts of hydrocarbon thiophosphonic acids and the use of such salts in the formulation of premium motor oils is disclosed in U.S. Pat. No. 3,135,729 (Kluge et al.).

U.S. Pat. No. 3,405,054 discloses the use of phosphorus sulfide-olefinic polymer reaction products to prevent solids deposition in petroleum refinery processing equipment. The disclosure (Example 1) details the use of a polyisobutenylthiophosphonic acid as such a solids deposition inhibitor. Use of such acid, although successful as an antifoulant, may likely contribute to acidic corrosion of processing equipment.

Polyalkenylthiophosphonic acid and the alcohol/polyglycol esters thereof are disclosed in U.S. Pat. No. 3,281,359 (Oberender et al.). In Oberender et al., these compounds are disclosed as being useful "detergent-dispersant additives in lubricating oil, particularly petroleum lubricating oil" (see column 1, lines 20–21). Studies have demonstrated that many compounds known to be useful as lubricating oil detergent-dispersants do not adequately function as process antifoulants.

U.S. Pats. Nos. 4,024,051 and 4,024,048 (Shell) disclose, inter alia, certain phosphate, phosphite, thiophosphate and thiophosphite esters as antifoulants. The disclosures also teach that certain amine salts of the corresponding acids are useful. Of somewhat similar import is U.S. Pat. No. 4,105,540 (Weinland) which discloses ethylene cracking antifoulants that may comprise phosphate and phosphite esters and salts including certain amine salts.

Of somewhat lesser interest is thought to be U.S. Pat. No. 3,123,160 (Oberender et al.) which relates to a process for preparing monohydroxyalkyl hydrocarbyl thiophosphonates by reacting hydrocarbyl thiophosphoric acids with alkylene oxides in the absence of a catalyst.

Other patents which may be of interest to the present invention include: U.S. Pat. No. 3,105,810 (Miller) disclosing oil soluble alkaryl sulfur containing compounds as antifoulants; U.S. Pat. No. 4,107,030 (Slovinsky et al.) disclosing sulfanilic acid amine salt compounds as antifoulants; U.S. Pat. No. 3,489,682 (Lesuer) disclosing methods for preparing metal salts of organic phosphorus acids and hydrocarbon substituted succinic acids; and U.S. Pat. No. 2,785,128 (Popkin) disclosing methods for preparing metal salts of acidic-phosphorus-containing organic compounds.

U.S. Pat. Nos. 3,437,583 (Gonzalez); 3,567,623 (Hagney); 3,217,296 (Gonzalez); 3,442,791 (Gonzalez) and 3,271,295 (Gonzalez); 3,201,438 (Reed) and 3,301,923 (Skovronek) may also be mentioned as being of possible interest.

DETAILED DESCRIPTION OF THE INVENTION

Preparative routes for synthesizing the precursor polyalkenylthiophosphonic acids are well known; for instance, in aforementioned U.S. Pat. No. 3,281,359 (Oberender et al.), alkenyl polymers (e.g., polyethylene, polypropylene, polyisopropylene, polyisobutylene, polybutene, or copolymers comprising such alkenyl repeat unit moieties) are reacted with $P_2S_5$. The $P_2S_5$ is present in the reaction mass at about 5–40 wt % (based upon total weight of the reactants). The reaction is carried out at temperatures of from about 100°–320° C. in the presence of from about 0.1–5.0 wt % elemental sulfur. The reaction may be continued for about 1–10 hours and a mineral lubricating oil may be added to ensure liquidification of the reaction mass.

The resulting mineral oil diluted or undiluted alkenyl-$P_2S_5$ reaction product is then steam hydrolyzed at temperatures from within the range of about 100°–260° C. Usually at least one mole of steam is reacted per mole polyalkenyl-$P_2S_5$ reaction product. As reported in the U.S. Pat. No. 3,281,359, inorganic phosphorus acids may be also formed during the hydrolysis. These may be removed via standard techniques.

The resulting polyalkenylthiophosphonic acid (PATPA) is then reacted with an amine in the molar reactant range of PATPA:amine of about 1–2:2–1. This reaction can be completed in a non-polar solvent such as xylene or toluene or in DMSO or in an aqueous medium in accordance with conventional techniques.

At present, the precursor PATPA which is preferred for use in preparing the PATPA-amine salts is polyisobutenylthiophosphonic acid wherein the isobutenyl moiety of the acid has a molecular weight of about 1300. This particular acid may be prepared in accordance with the above-disclosed techniques or is available commercially. One such available commercial product is sold as a 40 vol % solution in mineral oil having a specific gravity of 0.92 at 60° F. and a viscosity of 63.9 CST at 210° F.

As to the amines which may be used to form the PATPA-amine addition salts, alkanolamines, amines/-fatty amines, oxyalkylene amines and hydroxylated polyamines may be mentioned. The alkanolamines are represented by the structural formula

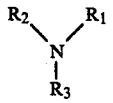

(I)

wherein $R_1$, $R_2$ and $R_3$ may be the same or different and are chosen from H, lower alkanol ($C_1$–$C_7$), alkyl ($C_1$–$C_{22}$) and aryl (mono and dinuclear) with the proviso that at least one of $R_1$, $R_2$ and $R_3$ is lower alkanol. Representative compounds include monoethanolamine, diethanolamine, triethanolamine, bis-(2-hydroxyethyl)-butylamine, N-phenyldiethanolamine, diisopropanolamine, triisopropanolamine, and the like. One exemplary alkanolamine is bis-(2-hydroxypropyl)-cocoamine.

The amines/fatty amines have the structure

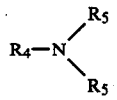

(II)

wherein $R_4$ and $R_5$ are independently chosen from H or 1 - $C_{22}$ alkyl such as cocoamine, tallowamine, cetylamine, heptadecylamine, n-octylamine, n-decylamine, laurylamine, myristylamine, and the like, such that at least one R group is an alkyl group.

The oxyalkylene amines are amines or polyamines which have been reacted with alkylene oxides such as ethylene or propylene oxide or mixtures thereof. These amines have the general structure

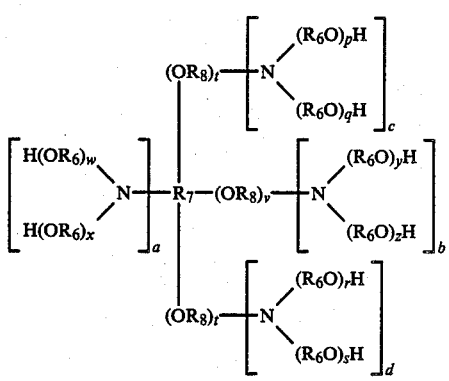

(III)

wherein each $R_6$, when present, is independently chosen from $C_1$–$C_8$ alkylene, $R_7$ is $C_1$–$C_{20}$ alkylene, $R_8$, when present, is chosen from $C_1$–$C_8$ alkylene or from mixed $C_1$–$C_8$ alkylene groupings; a,b,c, and d are each independently chosen and are 0 or 1 with the proviso that at least one of a,b,c, and d is present; p,q,r,s,t,v,w,x,y and z are independently chosen from integers of from 0 to 100.

The oxyalkylene amines (III) include the "Jeffamine" ® series mono, di, and triamines which are available from Texaco Chemical Company. Exemplary oxyalkylene amines (III) include ethoxylated and/or propoxylated polyamines such as $NH_2—CH(CH_3)CH_2—[OCH_2CH(CH_3)]_x—NH_2$ or $NH_2—CH(CH_3)CH_2—[OCHCH_3CH_2]_x—[OCH_2CH_2]_y—[OCH_2CH(CH_3)]_z—NH_2$ OR $$\begin{array}{l} \qquad\qquad CH_2—[OCH_2CH(CH_3)]_x—NH_2 \\ \qquad\qquad\quad | \\ CH_3—CH_2—C—CH_2—[OCH_2CH(CH_3)]_y—NH_2 \\ \qquad\qquad\quad | \\ \qquad\qquad CH_2—[OCH_2CH(CH_3)]_2—NH_2 \end{array}$$

Another series of amines which may be reacted with PATPA are hydroxylated polyamines of the formula (IV)

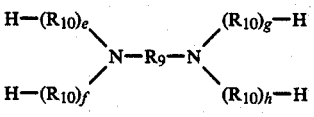

(IV)

wherein $R_9$ is $C_1$–$C_5$ alkylene, each $R_{10}$ is chosen independently from hydroxylated $C_1$–$C_5$ alkylene or $C_1$–$C_{20}$ alkylene; e, f, g, and h are each independently chosen from 0 or 1 with the proviso that at least one of e,f,g, and h are present.

One preferred hydroxylated polyamine (IV) is N, N, N', N'-tetrakis-(2-hydroxypropyl)ethylenediamine of the structure

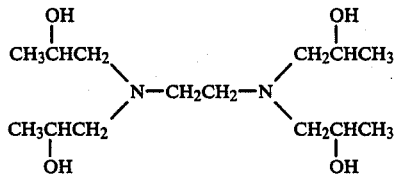

Another exemplary hydroxylated polyamine is N, N', N'-tris-(2-hydroxyethyl)-N-tallow - 1,3-diaminopropane

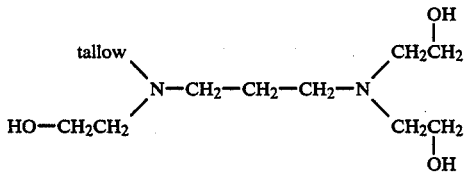

The resulting PATPA-amine antifoulants are dispersed within the petroleum hydrocarbon or petrochemical within the range of about 0.5–10,000 ppm of antifoulant based upon one million parts petroleum hydrocarbon or petrochemical. Preferably, the antifoulant is added in an amount of from about 1–1,000 ppm.

EXAMPLES

The invention will now be further described with reference to a number of specific examples which are to be regarded solely as illustrative and not as restricting the scope of the invention.

In order to ascertain the antifoulant efficacy of the compounds of the present invention, apparatuses were used to pump process fluid (crude oil) from a Parr bomb through a heat exchanger containing an electrically heated rod. Then the process fluid is chilled back to room temperature in a water-cooled condenser before being remixed with the fluid in the bomb. The system is pressurized by nitrogen to minimize vaporization of the process fluid.

The Dual Fouling Apparatus (DFA) used to generate the test data shown in Table I contains two heated rod exchangers (sides 1 and 2) that are independent except for a common pump drive transmission. In the DFA tests the rod temperature was controlled at 800° F. As fouling on the rod occurs, less heat is transferred to the fluid so that the process fluid outlet temperature decreases.

Accordingly, antifoulants are said to provide antifouling protection based on the percent reduction on the rod $\alpha T$ when compared to a control test (no antifoulant) in accordance with the following equation:

$$[\Delta T(\text{control}) - \Delta T(\text{treatment})]/\Delta T(\text{control}) * 100 = \%\ \text{Protection}$$

Additionally, antifoulant protection in the DFA tests was determined by comparing the summed areas under the fouling curves of the oil outlet temperatures for control, treated and ideal (nonfouling) runs. In this method, the temperatures of the oil inlet and outlet and rod temperatures at the oil inlet (cold end) and outlet (hot end) are used to calculate Urig coefficients of heat transfer every 30 minutes during the tests. From these Urig coefficients, areas under the fouling curves are calculated and summed over the tests for the control and treatments. The ideal case is represented as the summed area using the highest Urig coefficients. Comparing the areas of control runs (averaged) and treated runs vs the ideal area in the following equation results in a percent protection value for antifoulants.

$$\frac{\text{Area (treatment)} - \text{Area (control)}}{\text{Area (ideal)} - \text{Area (control)}} * 100 = \%\ \text{Protection}$$

The ideal areas for each side shown in Table 2 differed because the cold end rod temperature on side 2 was measured closer to the hot end of the rod than it was on side 1. This higher cold end rod temperature resulted in lower Urig coefficients and areas for side 2.

The polyisobutenylthiophosphonic acid (PIBTPA) used for the tests was purchased and was reputedly prepared similar to the procedure outlined in U.S. Pat. No. 3,281,359. As expressed therein, the polyalkenyl/$P_2S_5$ reaction product may be prepared by reacting alkenyl polymers such as polyethylene, polypropylene, polyisobutylene, polybutene or copolymers comprising such alkenyl repeat unit moieties with $P_2S_5$ (at about 5–40 wt % of the reaction mass) at a temperature of from about 100° to 320° C. in the presence of between 0.1 and 5.0 wt % sulfur. The resulting reaction mixture is then diluted with mineral oil and is then steam hydrolyzed. The polyisobutenyl moiety used to prepare the PIBTPA used in preparing Examples 1–4 has been reported as having an average molecular weight of about 1300.

EXAMPLES 1 and 2

Preparation of Monoamine Reaction Products with PIBTPA

To 30 grams of PIBTPA (~0.01 mole) was added either 1.49 grams triethanolamine (~0.01 mole) or 2.1 grams of a cocoamine (~0.01 mole) (Examples 1 and 2, respectively), and shaken together vigorously until well distributed. When 700 ppm of Example 1 was tested in the Midwest refinery crude oil on the DFA, it exhibited 56–65% average reduction in fouling vs. the control (Table 1). Similarly, 700 ppm of Example 2 was tested and found to exhibit 37–44% average reduction in fouling vs. the control (Table 1). The cocoamine is actually a mixture of $C_8$, $C_{10}$, $C_{12}$, $C_{14}$, $C_{16}$ and $C_{18}$ saturated primary amines with C12 dodecylamine being the majority component.

EXAMPLES 3 and 4

Preparation of Diamine Reaction Products with PIBTPA

To 30 grams of PIBTPA (~0.01 mole) was added either 2.92 grams of a 50% solution of N, N, N', N' tetrakis (2-hydroxypropyl) ethylene diamine (TOPEDA) in heavy aromatic naphtha (~0.01 mole) or 5.84 grams (~0.02 moles) of TOPEDA solution (Examples 3 and 4, respectively) and shaken together vigorously until well distributed. When 700 ppm of Example 3 was tested on the DFA as per above, it showed 51% average reduction in fouling vs. the control (Table 1). Similarly, 700 ppm of Example 4 was tested on the DFA and found to reduce fouling by an average of 39–40% vs. the control (Table 1).

TABLE I

Process Antifoulants - Dual Fouling Apparatus
Midwest Refinery Crude Oil
800° F. Rod Set Point

| Additive (ppm) | Side | Runs | ΔT (Avg) | % Protection | Area (Avg) | % Protection |
|---|---|---|---|---|---|---|
| Blank | 1 | 4 | 81 | 0 | 208.9 | 0 |
| Blank | 2 | 6 | 78 | 0 | 180.0 | 0 |
| Ex. 1 (700) | 1 | 1 | 20 | 75 | 253.6 | 69 |
| (TEA-PIBTPA) | 2 | 2 | 42 | 46 | 209.4 | 63 |
| AVERAGE | | 3 | | 56 | | 65 |
| Ex. 2 (700) | 1 | 2 | 62 | 23 | 227.4 | 29 |
| (Cocoamine-PIBTPA) | 2 | 1 | 28 | 64 | 214.3 | 73 |
| AVERAGE | | 3 | | 37 | | 44 |
| Ex. 3 (700) (TOPEDA-PIBTPA) (1:1 moles) | 1 | 2 | 40 | 51 | 241.6 | 51 |
| Ex. 4 (700) | 1 | 1 | 37 | 54 | 241.2 | 50 |
| (TOPEDA-PIBTPA) (2:1 moles) | 2 | 1 | 57 | 27 | 193.2 | 28 |
| AVERAGE | | 2 | | 40 | | 39 |
| PIBTPA (700) | 1 | 1 | 59 | 27 | 224.1 | 24 |
| | 2 | 1 | 40 | 49 | 213.1 | 70 |
| AVERAGE | | 2 | | 38 | | 47 |

The PATPA-amine antifoulants of the invention may be used in any system wherein a petrochemical or hydrocarbon is processed at elevated temperatures, and wherein it is desired to minimize the accumulation of unwanted matter on heat transfer surfaces. For instance, the antifoulants may be used in fluid catalytic cracker unit slurry systems wherein it is common to employ significant amounts of inorganic catalyst in the hydrocarbon containing process stream.

In accordance with the patent statutes, the best mode of practicing the invention has been set forth. However, it will be apparent to those skilled in the art that many other modifications can be made without departing from the invention herein disclosed and described, the scope of the invention being limited only by the scope of the attached claims.

I claim:

1. A method for controlling the formation of fouling deposits in a hydrocarbon medium during processing thereof at elevated temperatures of from about 100° F.–1500° F., comprising dispersing within said hydrocarbon medium an antifouling amount of an antifoulant compound formed from reaction of a polyalkenylthiophosphonic acid compound and an amine.

2. A method as recited in claim 1 wherein between 0.5–10,000 ppm of said antifoulant is dispersed with said hydrocarbon medium.

3. A method as recited in claim 2 wherein between about 1–1000 ppm of said antifoulant is dispersed within said hydrocarbon medium.

4. A method as recited in claim 1 wherein said elevated temperatures are within the range of about 500° F.–1000° F.

5. A method as recited in claim 1 wherein said amine comprises a member or members selected from the groups (a), (b) (c) and (d) and mixtures thereof wherein (a) is

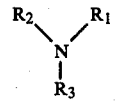

wherein $R_1$, $R_2$, and $R_3$ may be the same or different and are chosen from H, lower alkanol ($C_1$–$C_7$), alkyl ($C_1$–$C_{22}$) and aryl (mono and dinuclear) with the proviso that at least one of $R_1$, $R_2$, and $R_3$ is lower alkanol; (b) is

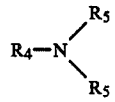

wherein $R_4$ and $R_5$ are independently chosen and are H or $C_1$–$C_{22}$ alkyl; (c) is

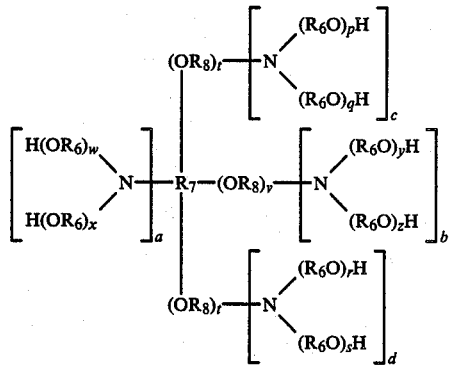

wherein each $R_6$, when present, is independently chosen from $C_1$–$C_8$ alkylene, $R_7$ is $C_1$–$C_{20}$ alkylene, $R_8$, when present, is chosen from $C_1$–$C_8$ alkylene or from mixed ($C_1$–$C_8$ alkylene) groupings; a, b, c, and d are each independently chosen and are 0 or 1 with the proviso that at least one of a, b, c, and d, is present; p,q,r,s,t,v,w,x,y and z are independently chosen from integers of from 0 to 100, and wherein (d) is

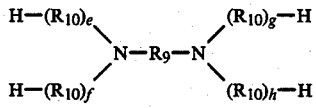

wherein $R_9$ is $C_1$–$C_5$ alkylene, each $R_{10}$ is chosen independently from hydroxylated $C_1$–$C_5$ alkylene or $C_1$–$C_{20}$ alkylene; e, f, g, and h are each independently chosen from 0 or 1 with the proviso that at least one of e, f, g, and h are present.

6. A method as recited in claim 5 wherein said amine is selected from group (a).

7. A method as recited in claim 5 wherein said amine is selected from group (b).

8. A method as recited in claim 5 wherein said amine is selected from group (c).

9. A method as recited in claim 5 wherein said amine is selected from group (d).

10. A method as recited in claim 6 wherein said amine is triethanolamine.

11. A method as recited in claim 7 wherein said amine is cocoamine.

12. A method as recited in claim 9 wherein said amine is N, N, N′, N′-tetrakis-(2-hydroxypropyl)ethylenediamine.

* * * * *